US006324722B1

(12) United States Patent
Takemoto

(10) Patent No.: US 6,324,722 B1
(45) Date of Patent: Dec. 4, 2001

(54) VACUUM-CLEANER WITH RECIRCULATION OF EXHAUST AIR

(75) Inventor: Rituo Takemoto, Kanagawa (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/355,996

(22) Filed: Aug. 24, 1999

(30) Foreign Application Priority Data

Dec. 24, 1997 (JP) ..... 9/353942
Dec. 25, 1997 (JP) ..... 9/355993
Dec. 26, 1997 (JP) ..... 9/360245

(51) Int. Cl.[7] ..... A47L 5/14
(52) U.S. Cl. ..... 15/346; 15/377
(58) Field of Search ..... 15/346, 377; 285/7; 24/339

(56) References Cited

U.S. PATENT DOCUMENTS 2,238,541 * 4/1941 Spagnolo ..... 15/346
3,694,848 * 10/1972 Alcala ..... 15/346
3,855,665 * 12/1974 Schwartz ..... 15/339
4,837,899 * 6/1989 Young ..... 24/339
4,884,315 * 12/1989 Ehnert ..... 15/346
5,553,347 * 9/1996 Inoue et al. ..... 15/346

FOREIGN PATENT DOCUMENTS

972510 * 8/1975 (CA) ..... 15/346
977910 * 11/1975 (CA) ..... 15/346
8-672 U * 4/1996 (JP) .
9-135795 * 5/1997 (JP) .
9-285426 * 11/1997 (JP) .

* cited by examiner

*Primary Examiner*—Robert J. Warden, Sr.
*Assistant Examiner*—Theresa T. Snider
(74) *Attorney, Agent, or Firm*—Oblon, Spivak, McClelland, Maier & Neustadt, P.C.

(57) ABSTRACT

In a vacuum cleaner, a suction side of an electric fan contained in a cleaner main body is connected to a suction port body via a suction air passage and an exhaust side of the electric fan is connected to the suction port body via an exhaust air passage. Air, passage connecting portions for removably connecting the suction port body to the cleaner main body are provided between both air passages.

10 Claims, 15 Drawing Sheets

VACUUM-CLEANER WITH RECIRCULATION OF EXHAUST AIR

BACKGROUND OF THE INVENTION

1. Field of the Invention

The present invention relates to a vacuum cleaner in which exhaust air is not discharged out of a cleaner main body but is returned into a suction port body to be recirculated.

2. Discussion of the Related Art

As the vacuum cleaner of this type, for example, one shown in FIG. 18 has been disclosed (see Japanese Utility Model Publication No. 39-36553).

Referring to FIG. 18, a vacuum cleaner includes a cleaner main body 1; a filter 2 disposed in the cleaner main body 1; a dust collecting chamber 3 formed in the filter 2; an electric fan 4 disposed in the cleaner main body 1 in such a manner that the suction side thereof is communicated to the dust collecting chamber 3; a suction side connecting port 5 provided in the cleaner main body 1 in such a manner as to be communicated to the dust collecting chamber 3; an exhaust side connecting port 6 provided in the cleaner main body 1 in such a manner as to be communicated to the exhaust side of the vacuum cleaner. A suction port body 7 is connected to the cleaner main body 1 via a hose and a connecting pipe 8.

The suction port body 7 has an exhaust air passage 9 for blowing exhaust air from the front side to the underside of a suction port 7*a*, and a suction air passage 10 for sucking dust from the suction port 7*a*. The connecting pipe 8 has an inner/outer dual structure of an inner pipe 8*a* and an outer pipe 8*b*. A suction air passage 11 in the inner pipe 8*a* is communicated to the suction side connecting port 5 and the suction air passage 10, and an exhaust air passage 12 between the inner pipe 8*a* and the outer pipe 8*b* is communicated to the exhaust side connecting port 6 and the exhaust air passage 9.

In such a vacuum cleaner, dust sucked together with air from the suction port 7*a* is sucked in the dust collecting chamber 3 via the suction air passages 10 and 11 and is caught by the filter 2. On the other hand, the air cleaned by the filter 2 is guided via the electric fan 4 into the exhaust air passage 12 and the exhaust to air passage 9 a front side of the suction port 7*a*. The air blows dust on a carpet or cleaning plane 13 into an intake side of the suction port 7*a*. The dust thus blown is sucked again in the suction air passage 10. The air is thus recirculated.

Vacuum cleaners shown in FIG. 19. (see Japanese Laid-open Utility Model No. 50-97269) and FIG. 20 (Japanese Laid-open Utility Patent No. 51-95266) are configured so that, when an electric fan 515 in a cleaner main body 514 is operated, a suction negative pressure caused by operation of the electric fan 515 is applied to a suction port body 518 via a dust collecting chamber 516 in the cleaner main body 514 and a suction pipe 517, to suck dust together with air from the suction port body 518. The dust sucked in the suction port body 518 is sucked into the dust collecting chamber 516 via the suction pipe 517 and is caught by a filter 519. The air cleaned by the filter 519 is exhausted in an exhaust chamber 520 disposed behind the electric fan 515, and is guided back to the suction port body 518 via an exhaust pipe 521. The air thus guided is blown and sucked together with dust on a carpet or cleaning plane 522 in the suction port body 518. The air is thus recirculated.

Incidentally, the vacuum cleaner shown in FIG. 18 has a connecting structure such that the end surfaces of the connecting ends of the connecting pipe 8 and the suction port body 9 are in abutment with each other. In order to enhance airtightness of an abutted portion between the end surfaces of the connecting ends of the connecting pipe 8 and the suction port body 9, flanges of both the connecting ends are rigidly fixed to each other over the entire periphery via C-shaped fixtures F.

Such a structure, however, has a problem. Since the thickness of each of the end surface portions of the connecting ends of the connecting pipe 8 and the suction port body 9 is small, it is very difficult to simply ensure airtightness, and further the suction port body 7 cannot be replaced by another suction device or cannot be, if it fails, exchanged for a new one.

The vacuum cleaner shown in FIG. 18 has another problem. Since the vacuum cleaner shown in FIG. 18 is configured such that the suction air passage 11 and the exhaust air passage 12 are provided in the connecting pipe 8 having the inner/outer dual structure, it is impossible to remove the exhaust air passage 12 from the suction port body 9 and separate it from the suction air passage 11, and use the separated exhaust air passage 12 for blowing dust off the cleaning plane. The vacuum cleaners shown in FIGS. 19 and 20 have a different problem. Since the vacuum cleaners are configured such that the suction pipe 517 and the exhaust pipe 521 are juxtaposed and integrated with each other, it is impossible to separate the exhaust pipe 521 from the suction pipe 517 and the suction port body 518, and use the separated exhaust pipe 521 for blowing dust off the cleaning plane.

The vacuum cleaner shown in FIG. 18 has also an inconvenience. Since a fan 14 rotated by exhaust air from the exhaust air passage 12 is provided in the suction port body 7 and the fan 14 is configured such that brushes 16 are rotated via a pulley mechanism, the connecting pipe 8 is not provided with a handling side operating portion for operating a turn-on/off switch of the fan 14 and the electric fan 4.

On the other hand, there is known a vacuum cleaner of a type in which a flexible hose having a spirally corrugated structure extends from a cleaner main body, and a handling side operating portion for controlling an electric fan is provided at a leading end portion of the hose.

A suction port body is connected to an end of the hose via an extension pipe, wherein the turn-on/off switch, the output, and the like of the electric fan can he controlled by a key-operation of the handling side operating portion while the suction port body is moved. In the conventional vacuum cleaner of this type, however, a lead wire and the like extending from the cleaner main body to the handling side operating portion is spirally buried along an accordion-like outer peripheral portion of the hose.

Accordingly, if the above hose is applied to the vacuum cleaner shown in FIG. 18, there arises a problem that, since the lead wire is spirally wound on the hose, the weight of the hose portion is not reduced and it takes a lot of labor to manufacture the hose. Further, if the lead wire is provided in the suction air passage 11, there occurs a problem in that the sucked dust is caught by the lead wire and thereby the lead wire may be disconnected or the suction air passage may be clogged with the sucked dust.

SUMMARY OF THE INVENTION

A first object of the present invention is to provide a vacuum cleaner in which a suction port body is removably mounted to a cleaner main body or a connecting pipe, whereby the suction port body can be replaced by another attachment or can be, if it fails, simply exchanged for a new one.

A second object of the present invention is to provide a vacuum cleaner capable of separating a flexible exhaust hose from a suction hose and using the exhaust hose for blowing dust.

A third object of the present invention is to provide a vacuum cleaner which is capable of facilitating wiring to a handling side operating portion, reducing the weight of an electric wire disposed for a pipe body having a dual structure, and facilitating the manufacture of the pipe body having a dual structure, and which is particularly characterized in that, even when the electric wire is disposed in the pipe body having a dual structure, it does not cause clogging of the pipe body with dust, after being disconnected, and can freely follow the bending of the pipe body.

To achieve the first object, according to the invention, there is provided a vacuum cleaner in which a suction side of an electric fan contained in a cleaner main body is connected to a suction port body via a suction air passage and an exhaust side of the electric fan is connected to the suction port body via an exhaust air passage. The vacuum cleaner has an air passage connecting portion for removably connecting the suction port body to the cleaner main body and is provided between the both air passages.

To achieve the second object, according to the invention, there is provided a vacuum cleaner in which a suction side of an electric fan contained in a cleaner main body is connected to a suction port body via a suction air passage and an exhaust side of the electric fan is connected to the section port body via an exhaust air passage, wherein at least part of the suction air passage and at least part of the exhaust air passage are respectively formed by a flexible suction hose and a flexible exhaust hose which are connected to the cleaner main body; and the two hoses are separably juxtaposed and held together.

To achieve the third object, according to the invention, there is provided a vacuum cleaner characterized in that a pipe body for connecting a cleaner main body including an electric fan to a suction port body has a suction air passage for supplying suction air from the suction port body into the cleaner main body, and an exhaust air passage for circulating exhaust air from the electric fan into the suction port body; and a portion of the exhaust air passage extending from the cleaner main body to a handling side operating portion of the pipe body for controlling the electric fan is provided with a lead wire for controlling the electric fan by operation of the handling side operating portion.

According to the invention described having the above-described configuration, since the air passage connecting portion for removably connecting the suction port body to the cleaner main body is provided on the way between both air passages, the suction port body can be removably connected to the cleaner main body or the connecting pipe. As a result, the suction port body can be replaced by another attachment or can be, if it fails, simply exchanged for a new one.

According to the invention described, at least part of the suction air passage and at least part of the exhaust air passage are respectively formed by a flexible suction hose and a flexible exhaust hose which are connected to the cleaner main body, and the two hoses are separably juxtaposed and held together. Accordingly, the flexible exhaust hose separated from the suction hose can be used for blowing dust.

According to the invention described, a portion of the exhaust air passage extending from the cleaner main body to a handling side operating portion of the pipe body for controlling the electric fan is provided with a lead wire for controlling the electric fan by operation of the handling side operating portion. As a result, since the exhaust air from which dust has been already collected flows in the portion of the exhaust air passage extending from the cleaner main body to the handling side operating portion, it is possible to eliminate an inconvenience that the dust is caught by the leading wire and thereby the exhaust air passage is clogged with the entangled dust or the leading end is disconnected. Further, by extending the lead wire provided in the exhaust air passage nearly in line along the longitudinal direction of the exhaust air passage, it is possible to shorten the length of the lead wire and reduce the weight of the lead wire, and also facilitate the layout of the lead wire and simplify the configuration of the pipe body and hence to reduce the number of manufacturing steps and the manufacturing cost.

DETAILED DESCRIPTION OF THE INVENTION

Hereinafter, embodiments of the present invention will be described with reference to FIGS. 1 to 7.

[First Embodiment]

Figure 6:
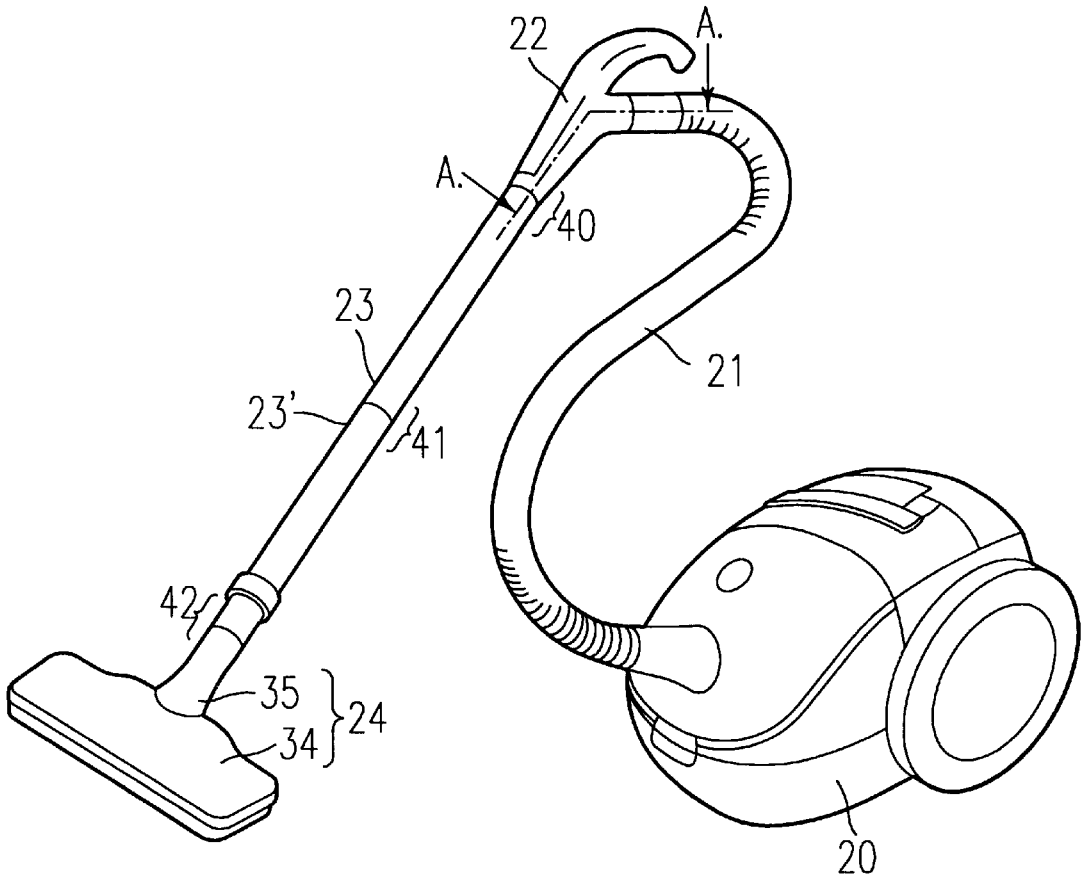
FIG. 6 is a perspective view of the external appearance of the vacuum cleaner having the configuration shown in FIGS. 1 to 5.

Referring to FIG. 6, a vacuum cleaner has the following elements; a cleaner main body 20; a dust collecting hose (flexible connecting pipe) 21 connected to the cleaner main body 20; a handling side connecting pipe (handling side pipe) 22 fixed at a leading end portion of the dust collecting hose 21; connecting pipes for extension (extension pipes) 23 and 23' connected in series to the handling side connecting pipe 22; and a suction port body 24 connected to the handling side connecting pipe 22 via the extension connecting pipes 23 and 23'.

Figure 7:
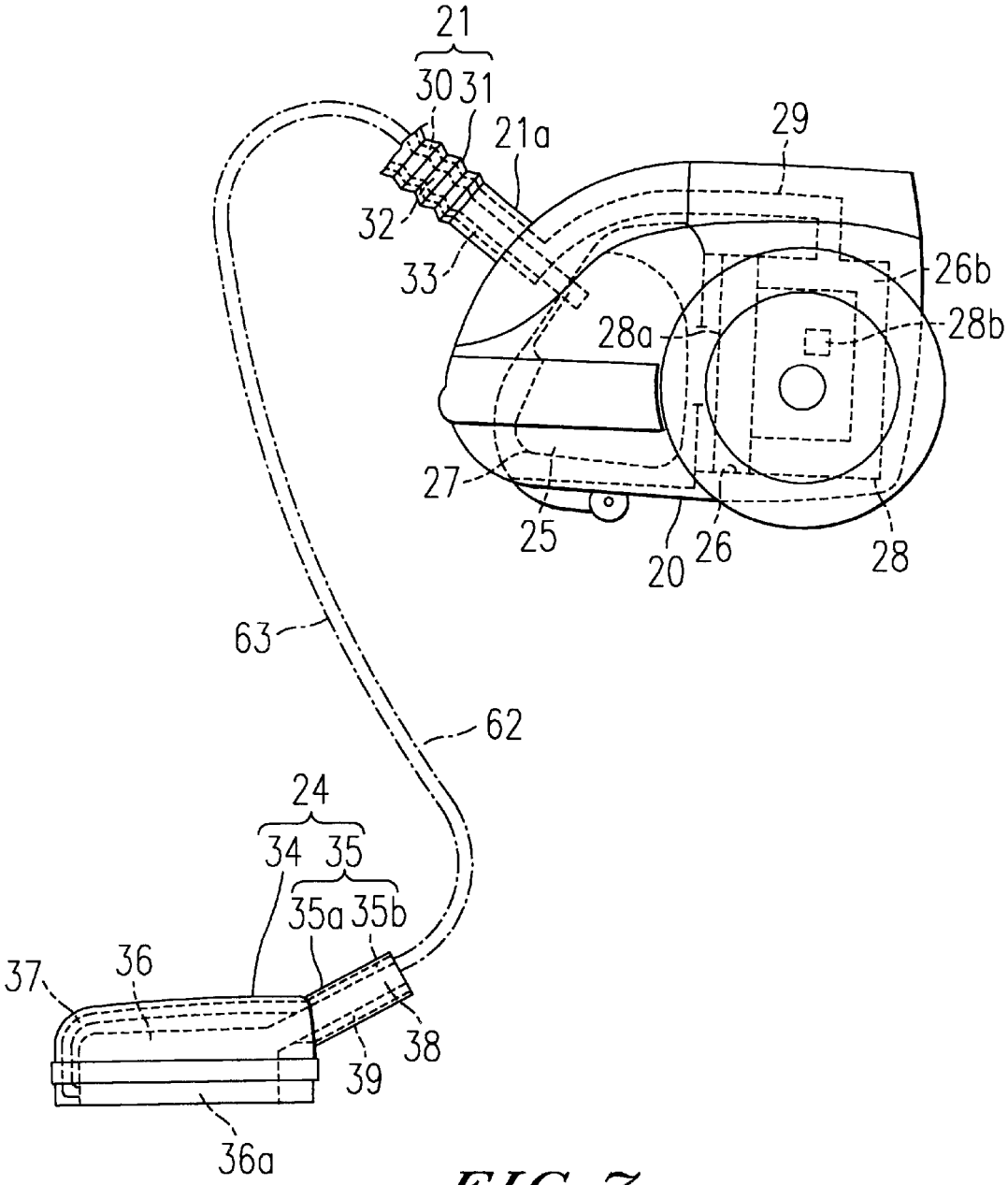
FIG. 7 is a view illustrating air passages of the vacuum cleaner shown in FIG. 6.

As shown in FIG. 7, a dust collecting chamber 25 is formed in a front portion of the cleaner main body 20, and a fan chamber 26 is formed in a rear portion of the dust collecting chamber 25. A paper pack filter 27 is disposed as a dust collecting filter in the dust collecting chamber 25, and an electric fan 28 with its suction side 28*a* communicated to the dust collecting chamber 25 is disposed in the fan chamber 26. An exhaust port (exhaust side) 28*b* of the electric fan 28 is opened in a rear portion of the fan chamber 26, and the rear portion of the fan chamber 26 is taken as an exhaust chamber 26*b* separated from the dust collecting chamber 25. An exhaust air passage 29 extending to a connecting portion 21*a*, connected to the cleaner main body 20, of the dust collecting hose 21 is formed in the cleaner main body 20.

The dust collecting hose 21 has an inner/outer dual structure of an accordion-like inner flexible hose 30 and an accordion-like outer flexible hose 31 which are coaxially formed. A suction air passage 32 is formed in the inner flexible hose 30, and an exhaust air passage 33 is formed between the flexible hoses 30 and 31.

The suction port body 24 has a suction port main body 34 and a suction port body side connecting pipe 35 mounted to the suction port main body 34. A downwardly opened suction chamber 36 is formed in the suction port main body 34. An exhaust air passage 37 communicated to the front side of a suction port 36*a* at the lower end of the suction chamber 36 is also formed in the suction port main body 34, The suction port body side connecting pipe 35 has an inner/outer dual structure of an inner pipe 35*a* and an outer pipe 35*b* which are coaxially formed. A suction air passage 38 communicated to the suction chamber 36 is formed in the inner pipe 35*a*, and an exhaust air passage 39 communicated to the exhaust air passage 37 is formed between the pipes 35*a* and 35*b*.

Referring again to FIG. 6, an air passage connecting portion 40 for removably connecting the handling side connecting pipe 22 to the extension connecting pipe 23, an air passage connecting portion 41 for removably connecting the extension connecting pipes 23 and 23' to each other, and an air passage connecting portion 42 for removably connecting the extension connecting pipe 23' to the suction port body side connecting pipe 35 have the same structure. Thus, only the air passage connecting portion 40 will be described with reference to FIGS. 1 to 5, and the reference numerals of the air passage connecting portions 41 and 42 are appended in the form of 40 (41, 42) in the figures and the explanation thereof is omitted. For the air passage connecting portion 40 between the handling side connecting pipe 22 and the extension connecting pipe 23, the handling side connecting pipe 22 is taken as a first connecting pipe and the extension connecting pipe 23 is taken as a second connecting pipe. For the air passage connecting portion 41 between the extension connecting pipes 23 and 23', the extension connecting pipe 23 is taken as a first connecting pipe and the extension connecting pipe 23' is taken as a second connecting pipe. For the air passage connecting portion 42 between the extension connecting pipe 23' and the suction port body side connecting pipe 35, the extension connecting pipe 23' is taken as a first connecting pipe and the suction port body side connecting pipe 35 is taken as a second connecting pipe.

Figure 1:
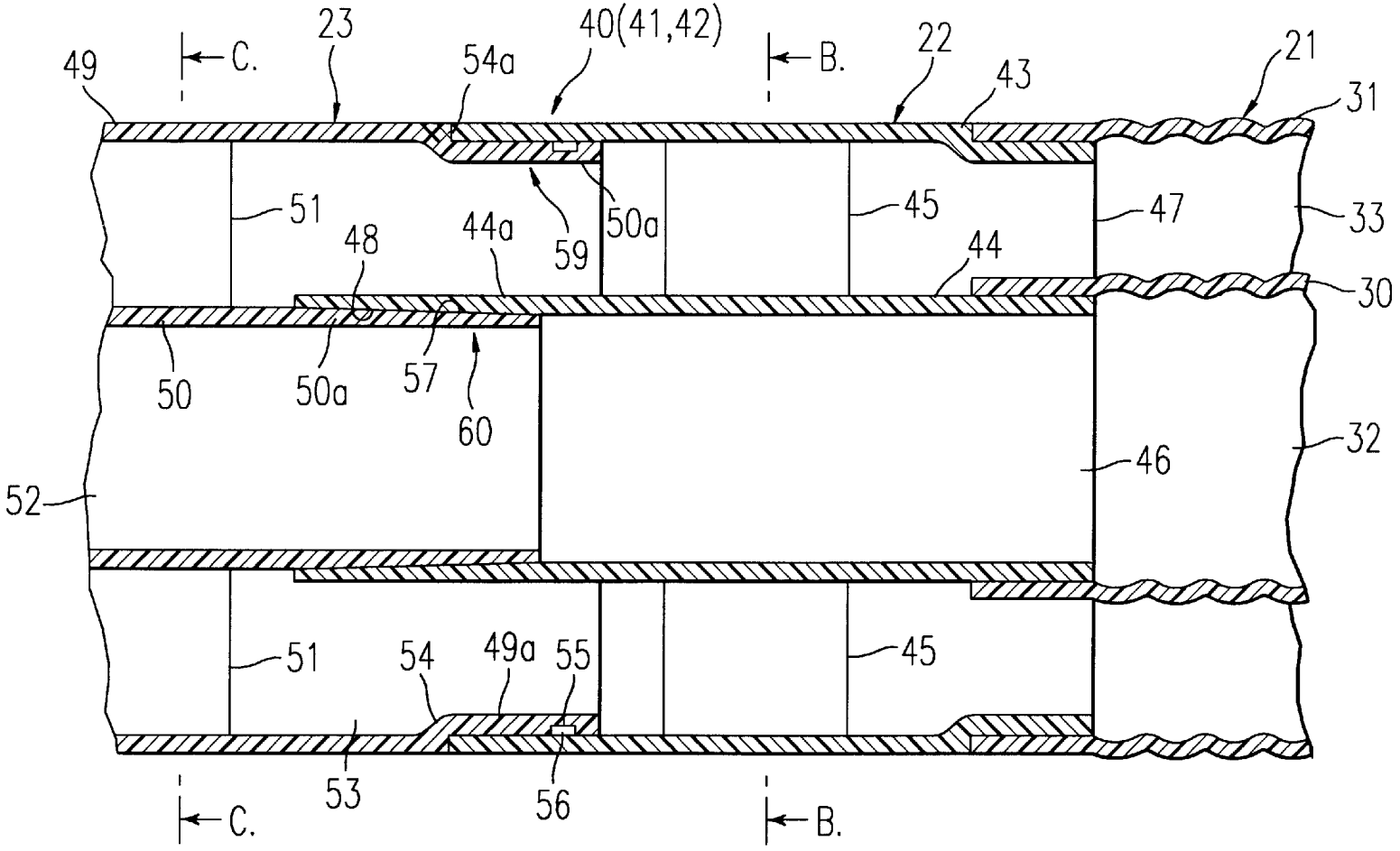
FIG. 1 is a sectional view, taken on line A—A of FIG. 6, showing an essential portion, that is, an air passage connecting portion of a vacuum cleaner of the present invention shown in FIG. 6.
Figure 2:
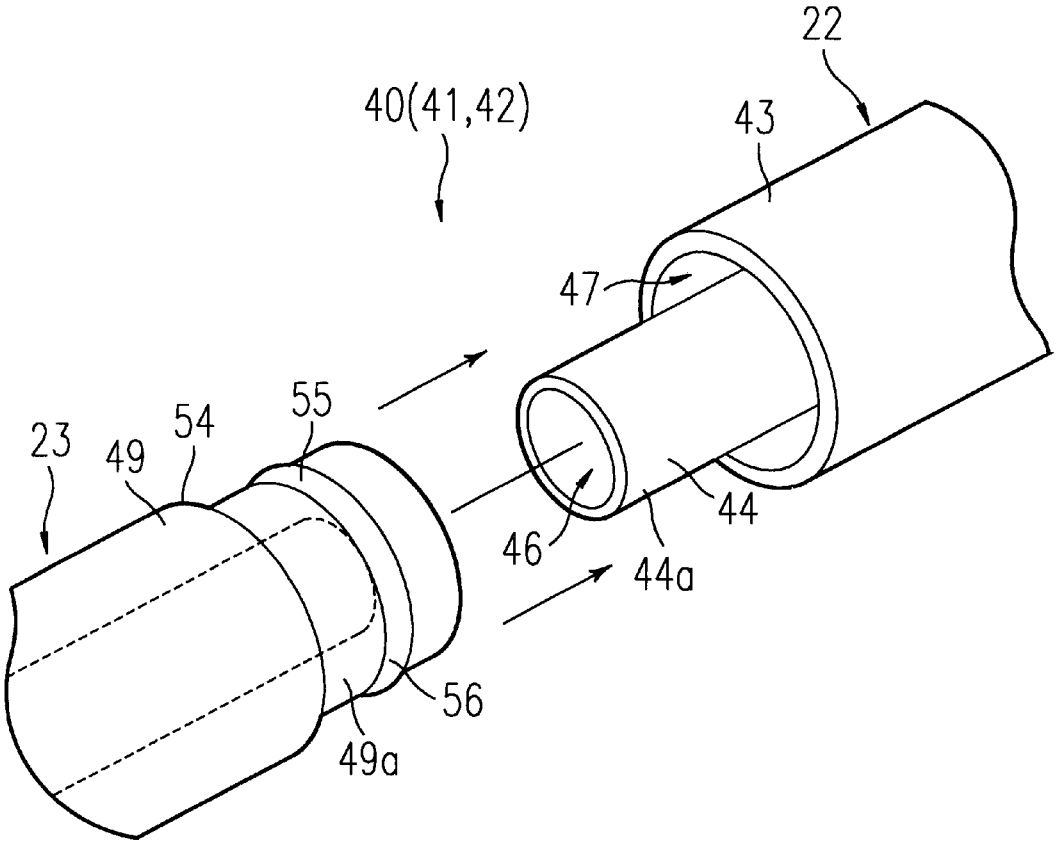
FIG. 2 is a perspective view separately showing essential portions of a handling side connecting pipe and an extension connecting pipe shown in FIG. 1.
Figure 3:
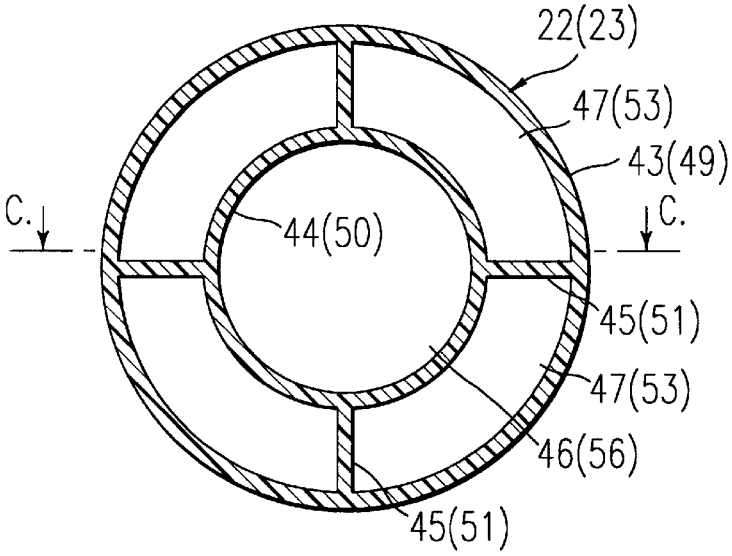
FIG. 3 is a sectional view taken on lines B—B and C—C of FIG. 1.
Figure 5:
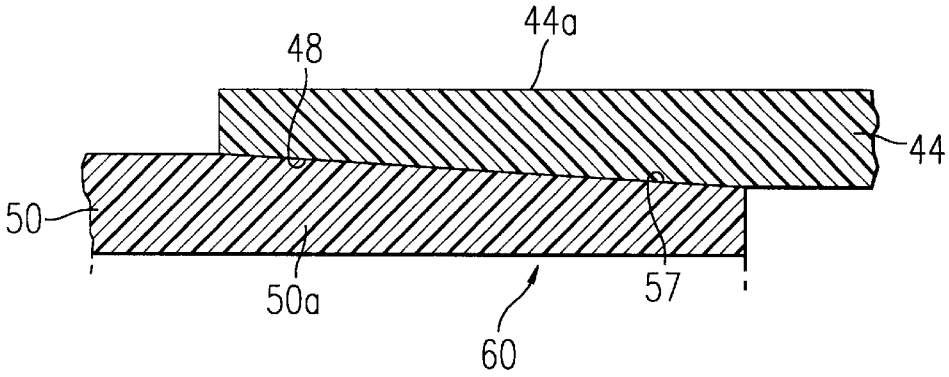
FIG. 5 is an enlarged view of an insertion-fitting portion between inner pipes shown in FIG. 1.

As shown in FIG. 1, in the air passage connecting portion 40, the handling side connecting pipe (or the first connecting pipe) 22 has an inner/outer dual structure in which an inner pipe 44 is coaxially disposed in an outer pipe 43, and as shown in FIG. 3, the pipes 43 and 44 are integrally joined to each other by a plurality of ribs 45. A suction air passage 46 is formed in the inner pipe 44 and an exhaust air passage 47 is formed between the pipes 43 and 44. As shown in FIGS. 1 and 2, a leading end portion 44*a* of the inner pipe 44 projects from the leading end of the outer pipe 43. As shown in FIGS. 1 and 5, the inner surface of the leading end portion 44*a* has a taper hole 48 whose diameter is gradually extended toward the leading end of the leading end portion 44*a*.

In the air passage connecting portion 40, the extension connecting pipe (or the second connecting pipe) 23 has an inner/outer dual structure in which an inner pipe 50 is coaxially disposed in an outer pipe 49. As shown in FIG. 3, the pipes 49 and 50 are integrally jointed to each other by a plurality of ribs 51. A suction air passage 52 is formed in the inner pipe 50 and an exhaust air passage 53 is formed between the pipes 50 and 51.

Figure 4:
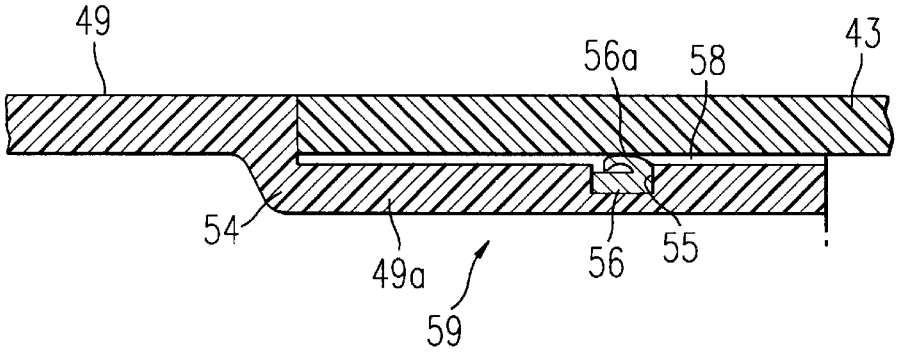
FIG. 4 is an enlarged view of an insertion-fitting portion between outer pipes shown in FIG. 1.

As shown in FIG. 2, the leading end portion of the outer pipe 49 has a small-diameter portion 49*a*. A stepped portion 54 is formed at a base portion of the small-diameter portion 49*a*. The small-diameter portion 49*a* has an annular holding groove 55 which is opened outwardly and annularly extends in the circumferential direction. An annular seal member 56 is fitted in and held by the annular holding groove 55. As shown in FIG. 4, the annular seal member 56 is provided with a lip portion 56*a* projecting from the annular holding groove 55. A leading end portion 50*a* of the inner pipe 50 is, as shown in FIG. if positioned slightly inwardly from the leading end of the outer pipe 49. Further, as shown in FIGS. 1 and 5, the outer surface of the leading end portion 50*a* has a taper outer surface 57 whose diameter is gradually reduced toward the leading end of the leading end portion 50*a*.

The handling side connecting pipe (or the first connecting pipe) 22 and the extension connecting pipe (or the second connecting pipe) 23 are insertion-connected to each other.

Specifically, the leading end portion 50*a* of the inner pipe 50 is inserted in and connected to the leading end portion 44*a* of the inner pipe 44 and the taper outer surface 57 of the leading end portion 50*a* is taper-fitted in the taper hole 48 of the leading end portion 44*a*, and simultaneously the small-diameter portion 49*a* of the outer pipe 49 is inserted in and connected to the leading end portion of the outer pipe 43. The outside diameter of the small-diameter portion 49*a* of the outer pipe 49 is formed to be slightly smaller than the inside diameter of the outer pipe 43, and in FIG. 4 a slight play (gap) 58 is formed between the small-diameter portion 49*a* and the outer pipe 43. The lip portion 56*a* of the annular seal member 56 is brought into elastic-contact with the inner surface of the outer pipe 43 to air-tightly seal the gap 58 between the small-diameter portion 49*a* and the outer pipe 43. Accordingly, even if there are slight dimensional variations in outside and inside diameters of the pipes 43, 44, 49 and 50, it is possible to easily connect the inner pipes 44 and 50 of FIG. 5 to each other and also connect the outer pipes 43 and 49 of FIG. 4 to each other while ensuring sufficient airtightness upon connection, hence to facilitating the manufacture of the connecting pipes.

In such a state, since the outer surfaces of the outer pipes 43 and 49 are continuous to each other at the same level, the external appearance of the joined connecting pipes becomes desirable.

Since an insertion-fitting portion 59 between the outer pipes 43 and 49 and an insertion-fitting portion 60 between the inner pipes 44 and 50 are, as shown in FIG. 1, overlapped to each other while being slightly offset from each other in the axial direction, the ends of the insertion-fitting portions (connecting portions) 59 and 60 between the outer pipes 43 and 49 and between the inner pipes 44 and 50 are not overlapped to each other. As a result, even if a bending stress is applied to the insertion-fitting portions 59 and 60, at the insertion-fitting portion 60 between the inner pipes 44 and 50, a shear force applied from the end of one inner pipe 44 (or 50) to the other inner pipe 50 (or 40) is reinforced by the insertion-fitting portion (connecting portion) 59 between the outer pipes 43 and 49; and at the Insertion-fitting portion (connecting portion) 59 between the outer pipes 43 and 49, a shear force applied from the end of one outer pipe 43 (or 49) to the other outer pipe 49 (or 43) is reinforced by the insertion-fitting portion (connecting portion) 60 between the inner pipes 44 and 50.

As a result, for example, in t:he case where the connecting portion between the outer pipes 43 and 49 is configured as described above in such a manner that the small diameter portion 49*a* is provided at the end portion of one outer pipe 49 to form the stepped portion 54 for forming the connecting portion with no external step thereby enhancing the external appearance of the connecting portion, even it a shear stress due to bending is applied to the stepped portion 54, such shear stress can be reinforced by the connecting portion between the inner pipes. This arrangement makes it possible to avoled the outer pipe from being broken at the stepped portion.

Next, the connection work at the air passage connecting portion 40 and the function thereof will be described.

The connection between the handling side connecting pipe 22 and the extension connecting pipe 23 is performed by connecting the inner pipes 44 and 50 to each other and then connecting the outer pipes 43 and 49 to each other. To be more specific, in the connection between the handling side connecting pipe 22 and the extension connecting pipe 23, the inner pipe 50 of the extension connecting pipe 23 is inserted in the inner pipe 44 of the handling side connecting pipe 22 by inserting the inner pipe 44 of the handling side connecting pipe 22 between the outer pipe 49 and the inner pipe 50 of the extension connecting pipe 23. Upon such an insertion operation, since the inner pipes 44 and 50 can be viewed from externally the insertion-connection between the inner pipes 44 and 50 can be easily performed.

After the above insertion-connection between the inner pipes 44 and 50 proceeds to some extent, the small-diameter portion 49*a* at the leading end of the outer pipe 49 is inserted in the leading end portion of the outer pipe 43. Finally, when the taper outer surface 57 of the inner pipe 50 is substantially brought into close-contact with the taper hole 48 of the inner pipe 44, the gap between an end surface 54*a* of the stepped portion 54 and the leading end of the outer pipe 43 is eliminated. Since the connection between the outer pipes 43 and 49 is performed after the connection between the inner pipes 44 and 50 is started and also the outer pipe 43 and the small-diameter portion 49*a* are dimensioned such that a slight gap is formed therebetween, the small-diameter portion 49*a* can be easily inserted in and connected to the outer pipe 43. In such an insertion-connection state, the annular seal member 56 of the small-diameter portion 49*a* is in elastic-contact with the inner surface of the outer pipe 43 to airtightly seal the gap between the outer pipe 43 and the small-diameter portion 49*a*, and the outer surfaces of the outer pipes 43 and 49 are continuous to each other at the same level, to ensure a desirable external appearance of the connecting portion between the outer pipes 43 and 49.

The separation between the handling side connecting pipe (or the first connecting pipe) 22 and the extension connecting pipe (or the second connecting pipe) 23 can be easily performed by pulling the connecting pipes 22 and 23 in the opposite direction in accordance with the procedure reversed to that described above.

The connection and separation at the air passage connecting portion 40 is similarly performed at the air passage connecting portions 41 and 42. In this way, as seen in FIG. 6, the suction port main body 24 can be simply, indirectly or directly mounted to or dismounted from the cleaner main body 20 or the connecting pipe 23'. Further, since the suction port body 24 can be simply, indirectly or directly mounted to or dismounted from the cleaner main body 20 or the connecting pipe 23', the suction port body 24 can be replaced by another attachment or can be, if it fails, simply exchanged for a new one.

In the state in which the connection at the air passage connecting portion 40 between the connecting pipes 22 and 23 is similarly performed at the air passage connecting portions 41 and 42, as seen in FIG. 1, the suction air passages 46 and 52 of the connecting pipes 22 and 23, a suction air passage (not shown) in the connecting pipe 23' in FIG. 6, the suction air passage 32 in the dust collecting hose 21 in FIG. 7, the suction air passage 38 in the suction port body 24, and the like constitute a series of suction air passages 62 for communicating the dust collecting chamber 25 of the cleaner main body 20 to the suction chamber 36 of the suction port body 24 as shown in FIG. 7. Similarly, as seen in FIG. 1, the exhaust air passages 47 and 53 of the connecting pipes 22 and 23, an exhaust air passage (not shown) of the connecting pipe 23' in FIG. 6, the exhaust air passage 33 in the dust collecting hose 21 in FIG. 7, the exhaust air passage 29 in the cleaner main body 20, the exhaust air passage 37 of the suction port body 24, and the like constitute a series of exhaust passages 63 for communicating the exhaust chamber 26*b* of the cleaner main body 20 to the suction chamber 36 of the suction port body 24.

In such a connection state, when the electric fan 28 is operated, it sucks air in the dust collecting chamber 25 to generate a suction negative pressure in the dust collecting chamber 25. The suction negative pressure thus generated is applied to the suction chamber 36 of the suction port body 24 via the suction air passages 62. As a result, dust sucked in the suction port body 24 together with air is further sucked to and caught by the paper pack filter 27 in the dust collecting chamber 25 via the suction air passages 62. The air sucked together with dust is cleaned by the paper pack filter 27, and is sucked by the electric fan 28, to be exhausted in the exhaust chamber 26*b* through the exhaust port 28*b*. The air exhausted in the exhaust chamber 26*b* is guided to the suction port body 24 via the exhaust air passages 63, being blown from the exhaust air passage 37 (one of the exhaust air passages 63) in the suction port body 24 in such a manner as to flow rearwardly from the front side of the suction port 36*a* of the suction chamber 36, and is sucked again, together with dust sucked up in the suction chamber 36, into the dust collecting chamber 25 via the suction air passages 62. The air is thus recirculated.

In the above-described circulation of air, at the air passage connecting portion 40 in FIG. 6, the suction negative pressure is applied in the suction air passages 46 and 52 of FIG. 3 in the direction where the insertion-connection between the inner pipes 44 and 50 becomes deeper. This arrangement is effective to strengthen the close-contact between the taper hole 48 of FIG. 5 in the inner pipe 44 and the taper outer surface 57 of the inner pipe 50. As a result, it is possible to sufficiently ensure the airtightness of the insertion-fitting portion 60 between the inner pipes 44 and 50 without provision of any seal member.

[Second Embodiment]

Figure 8:
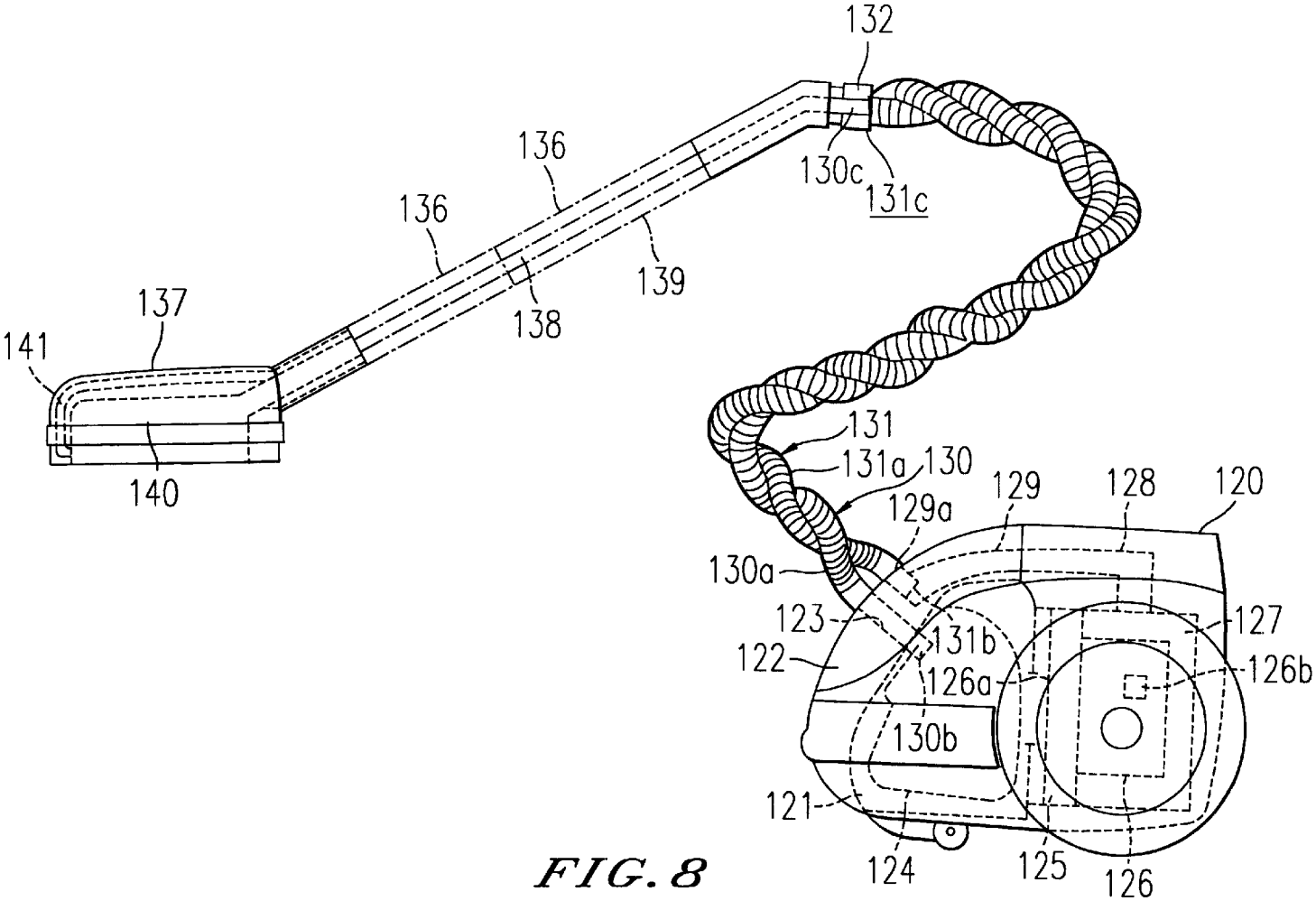
FIG. 8 is a schematic view illustrating air passages of a vacuum cleaner according to a second embodiment.
Figure 9:
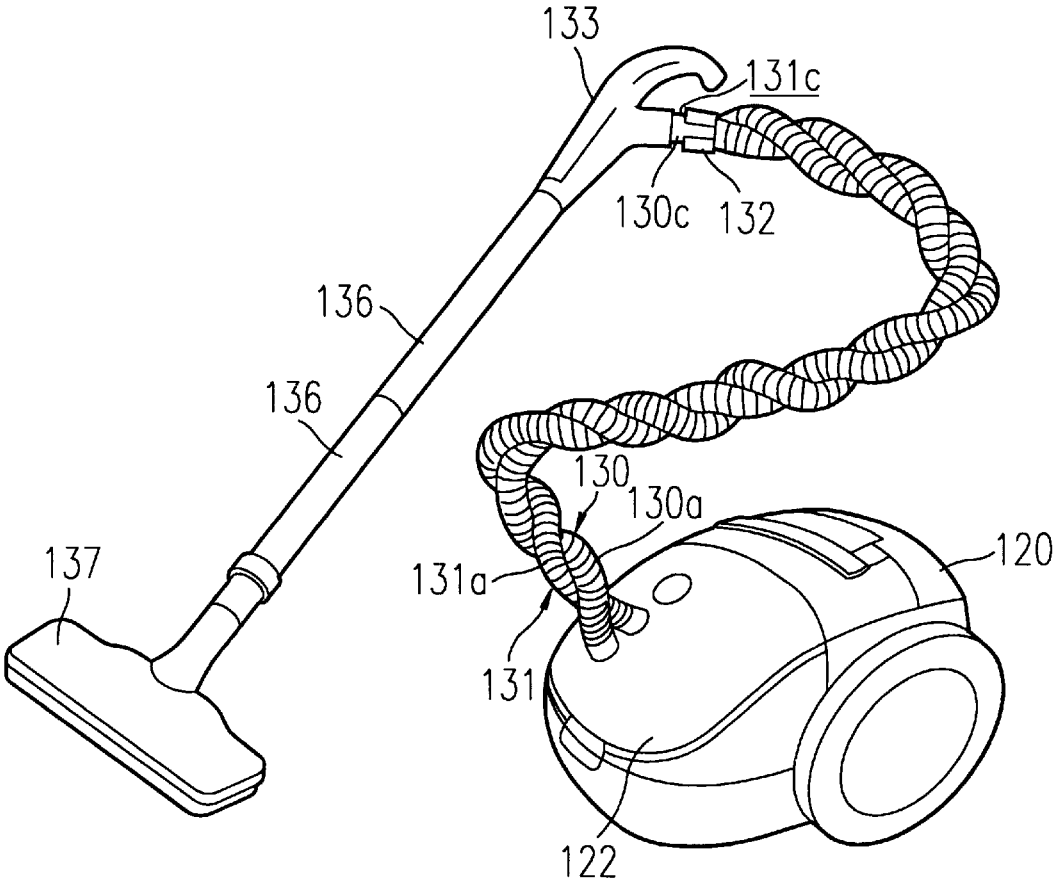
FIG. 9 is a perspective view of the external appearance of the vacuum cleaner shown in FIG. 8.

Referring to FIGS. 8 and 9, there is a cleaner main body 120 of a vacuum cleaner; a dust collecting chamber 121 formed in a front portion of the cleaner main body 120; a lid body (dust collecting chamber opening/closing lid) 122 for opening/closing the dust collecting chamber 121; a hose connecting port 123 formed in the lid body 122; and a paper pack filter (dust collecting filter) 124 disposed in the dust collecting chamber 121.

A fan chamber 125 is formed in a rear portion of the cleaner main body 120, and an electric fan 126 is disposed in the fan chamber 125. A suction port (suction side) 126*a* of the electric fan 126 is communicated to the dust collecting chamber 121. The rear portion of the fan chamber 125 is taken as an exhaust chamber 127 separated trout the dust collecting chamber 121, and an exhaust port (exhaust side) 126*b* of the electric fan 126 is opened in the exhaust chamber 127. An exhaust passage (exhaust air passage) 128 communicated to the exhaust chamber 127 is formed in an upper rear portion of the cleaner main body 120, and an exhaust passage (exhaust air passage) 129 communicated to the exhaust passage 128 and extending to the vicinity of the hose connecting port 123 is formed in the lid body 123. There is also a hose connecting port 129*a* for the exhaust passage 129.

Furthermore, there is a flexible suction hose 130 (flexible hose); and a flexible exhaust hose 131 (flexible hose). The suction hose 130 has an accordion-like extensible hose 130*a*, a connecting pipe 130*b* integrally provided at the base end (one end) of the hose 130*a*, and a connecting pipe 130*c* integrally provided at the other end (leading end or free end) of the hose 130*a*. The exhaust hose 131 has an accordion-like extensible hose 131*a*, a connecting pipe 131*b* integrally provided at the base end (one end) of the hose 131*a*, and a connecting pipe 131*c* integrally provided at the other end (leading end or free end) of the hose 131*a*.

The connecting pipe 130*b* of the suction hose 130 is insertion-connected to the hose connecting port 123, to be communicated to the paper pack filter 124 in the dust collecting chamber 121. The connecting pipe 131*b* of the exhaust hose 131 is connected to the hose connecting port 129*a*, to be communicated to the exhaust passage 129.

Figure 10:
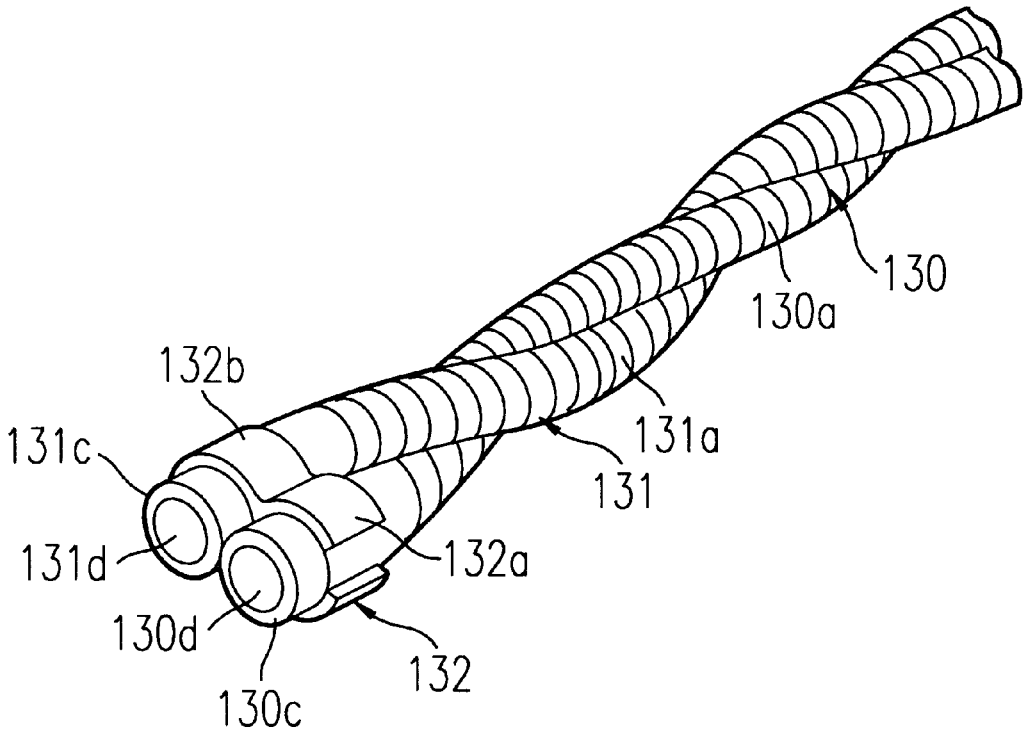
FIG. 10 is a perspective view partially showing a suction hose and an exhaust hose separated from a handling side pipe shown in FIGS. 8 and 9.
Figure 11:
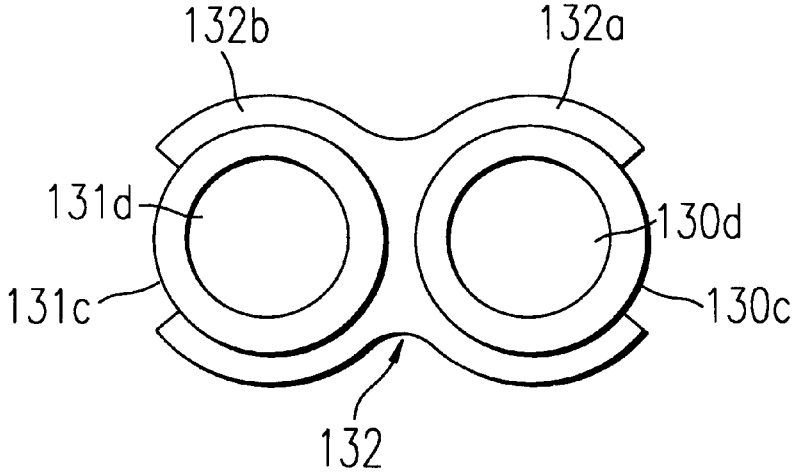
FIG. 11 is an enlarged view illustrating the leading ends of the hoses shown in FIG. 10.

The suction hose 130 and the exhaust hose 131 are spirally twisted. In such a state, as shown in FIG. 10, the connecting pipes 130*c* and 131*c* of the hoses 130 and 131 are removably inserted and fitted in C-shaped elastically holding members 132*a* and 132*b* of a connecting member 132, respectively, to be thus held. Accordingly, in this state, the hoses 130 and 131 are not separated from each other and are firmly held in the spirally twisted shape (twisted rope-shape).

Figure 12:
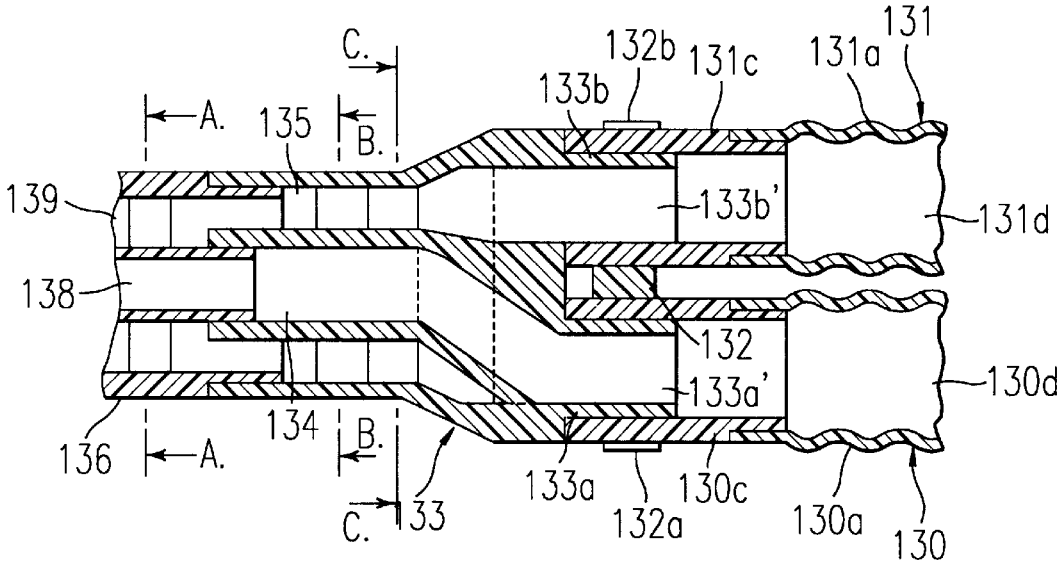
FIG. 12 is a sectional view, taken on line D—D of FIG. 13 (*a*), illustrating connection between the handling side pipe and the suction and exhaust hoses shown in FIG. 9.
Figure 13A:
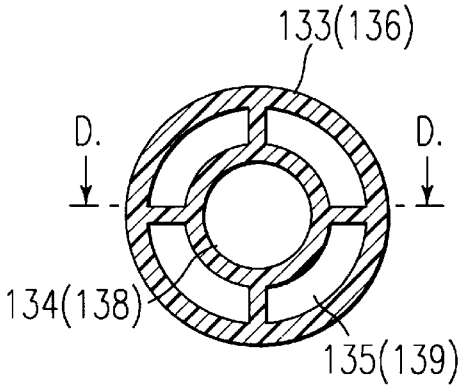
FIG. 13 (*a*) is a sectional view taken on lines A—A and B—B of FIG. 12, and FIG. 13(*b*) is a sectional view taken on line C—C of FIG. 12.
Figure 13B:
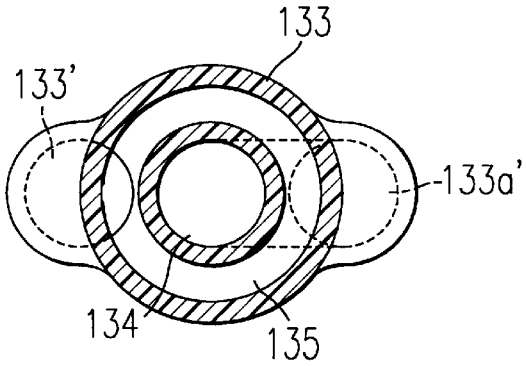

Connecting pipe portions 133*a* and 133*b* in FIG. 12 projectingly provided at the base end (one end) of a handling side connecting pipe (handling side pipe) 133 are inserted in and connected to the connecting pipes 130*c* and 131*c*, respectively. The handling side connecting pipe 133 has an inner/outer dual structure of a suction air passage 134 and an exhaust air passage 135. A suction air passage 133*a*' in the connecting pipe portion 133*a* is communicated to the suction air passage 134, and an exhaust air passage 133*b*' in the connecting pipe portion 133*b* is communicated to the exhaust air passage 135.

A suction port body 137 in FIG. 9 is connected to the other end of the handling side connecting pipe 133 via an extension pipe 136. The extension pipe 136 in FIG. 12 has an inner/outer dual structure of a suction air passage 138 and an exhaust air passage 139, and the suction port body 137 of FIG. 8 has a suction chamber 140 and an exhaust air passage 141. The leading end of the exhaust air passage 141, positioned at the lower end of the suction chamber 140, is opened rearwardly. The suction air passage 138 of the extension pipe 136 is communicated (connected) in FIG. 12 to the suction air passage 134 of the handling side connecting pipe 133 and to the suction chamber 140 of FIG. 8 in the suction port body 137, and the exhaust air passage 139 of the extension pipe 136 is communicated (connected) to the exhaust air passage 135 of FIG. 12 in the handling side connecting pipe 133 and to the exhaust air passage 141 of FIG. 8 in the suction port body 137.

Next, the vacuum cleaner having such a configuration will be described.

With this configuration, when the electric fan 126 is operated, a suction negative pressure caused by operation of the electric fan 126 is applied to the auction chamber 140 of the suction port body 137 via the dust collecting chamber 121, a suction air passage 130*d* of FIG. 12 in the suction hose 130, the suction air passages 133*a*' and 134 of the handling side connecting pipe 133, the suction air passage 138 of the extension pipe 136, and the like. Thus, as seen in FIG. 8, air and dust are sucked into the suction chamber 140. The dust sucked together with air in the suction chamber 140 is guided in the dust collecting chamber 121 via the suction air passage 138 of the extension pipe 136, the suction passages 133*a*' and 134 of FIG. 12 in the handling side connecting pipe 133 and the suction air passage 130*d* in the suction hose 130, and is caught by the paper pack filter 124 in FIG. 8.

In this case, the air sucked into the paper pack filter 124 is cleaned by the paper pack filter 124 and is sucked into the electric fan 126 through the suction port 126*a*, and thereafter, the air is exhausted in the exhaust chamber 127 from the exhaust port 126*b* of the electric fan 126. The exhaust air thus exhausted in the exhaust chamber 127 is guided into the exhaust air passage 141 of the suction chamber 140 via the exhaust air passages 128 and 129, an exhaust air passage 131*d* of FIG. 12 in the exhaust hose 131, the exhaust air passages 133*b*' and 135 of the handling side connecting pipe 133, and the exhaust air passage 139 of the extension pipe 136. Then, the exhaust air thus guided is blown rearwardly from the opening in FIG. 8 of the exhaust air pass age 141 formed at the lower portion of the suction chamber 140, to blow dust present on a carpet or the cleaning plane into the suction chamber 140. The exhaust air is thus recirculated (refluxed).

In the case of using the exhaust hose 131 for blowing dust on the surface to be cleaned, the hoses 130 and 131 may be separately released. The hoses 130 and 131 can be easily, separately released by pulling out the connecting pipe portions 130*c* and 131*c* of the hoses 130 and 131 from the connecting pipe portions 133*a* and 133*b* in FIG. 12 of the handling side connecting pipe 133 and further pulling out the connecting pipe portions 130*c* and 131*c* from the C-shaped elastically holding portions 132*a* and 132*b* of the connecting member 132. In such a separation state, the connecting pipe portion 131*c* of the exhaust hose 131 may be moved closer to the cleaning plane, whereby dust on the cleaning plane can be blown by the exhaust air blown from he connecting pipe portion 131*c*.

Figure 14:
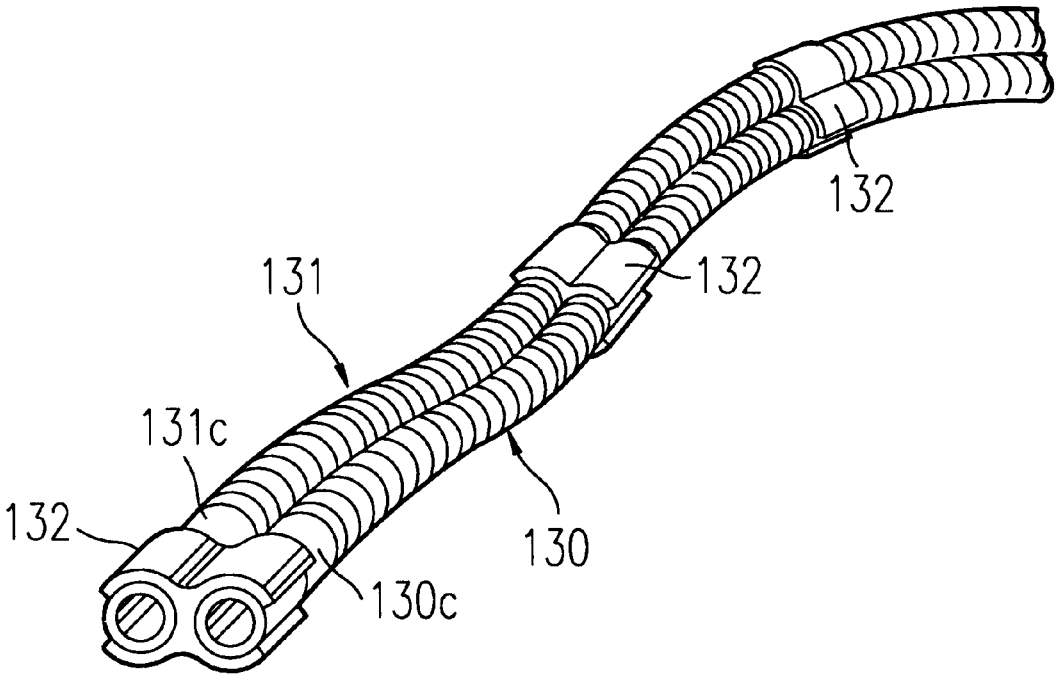
FIG. 14 is a view illustrating another example of holding the suction and exhaust hoses in the second embodiment.

In the above-described embodiment, the suction hose 130 and the exhaust hose 131 are held in the spirally twisted shape; however, the present invention is not necessarily limited thereto. For example, as shown in FIG. 14, the suction hose 130 and the exhaust hose 131 may be juxtaposed parallel to each other, and removably connected at a plurality of positions to each other by a plurality of connecting members 132. In the case of using the exhaust hose 131 for blowing of dust off the cleaning surface, the exhaust hose 131 may be configured to be separable from the suction hose 130. The extension pipe 136 in FIG. 12 may be divided into two parts like the extension pipes 23 and 23' in FIG. 6 of the first embodiment.

[Third Embodiment]

Figure 15:
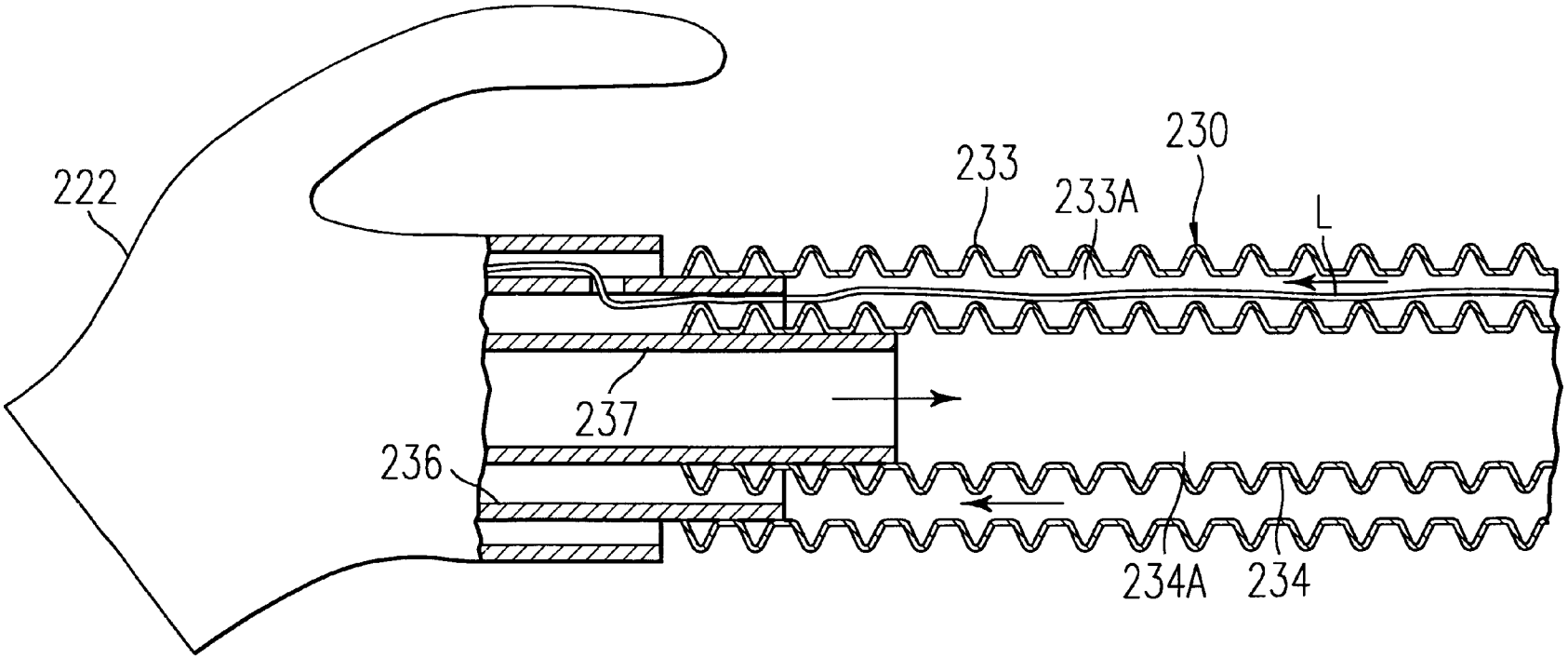
FIG. 15 is a sectional view showing the configuration of hoses in a third embodiment.
Figure 16:
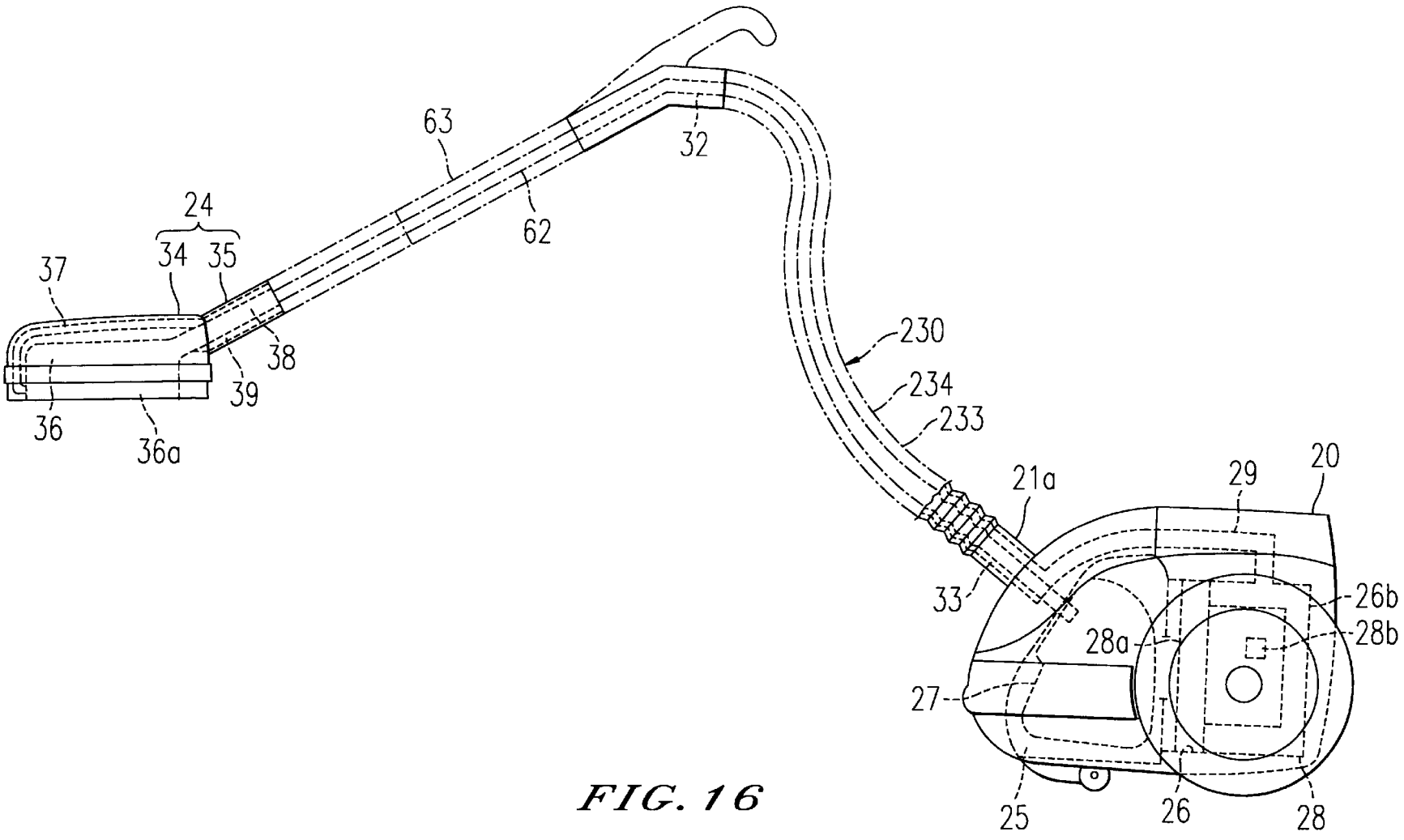
FIG. 16 is a view illustrating the connecting state between a suction passage and an exhaust passage of a circulating type vacuum cleaner according to the third embodiment.
Figure 17:
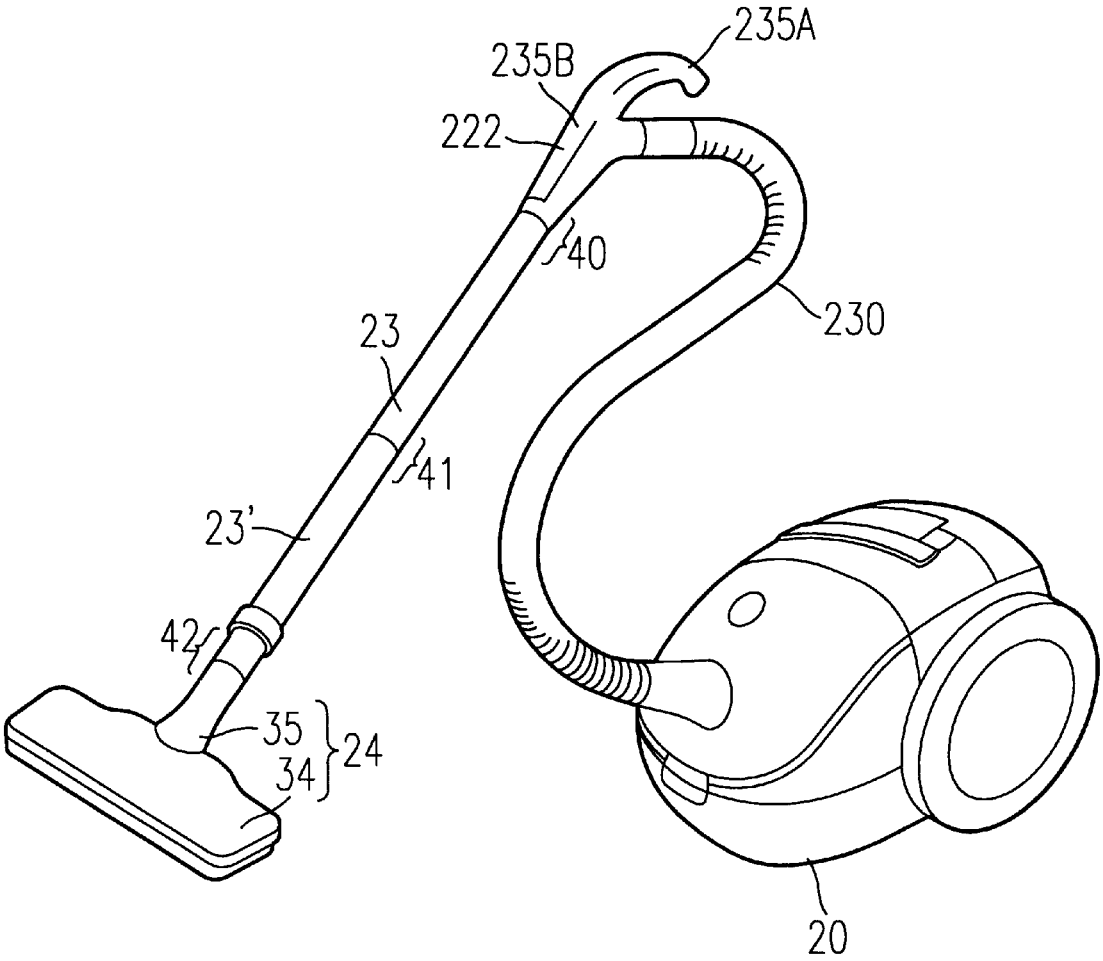
FIG. 17 is a perspective view showing the external appearance of the vacuum cleaner according to the third embodiment.
Figure 18:
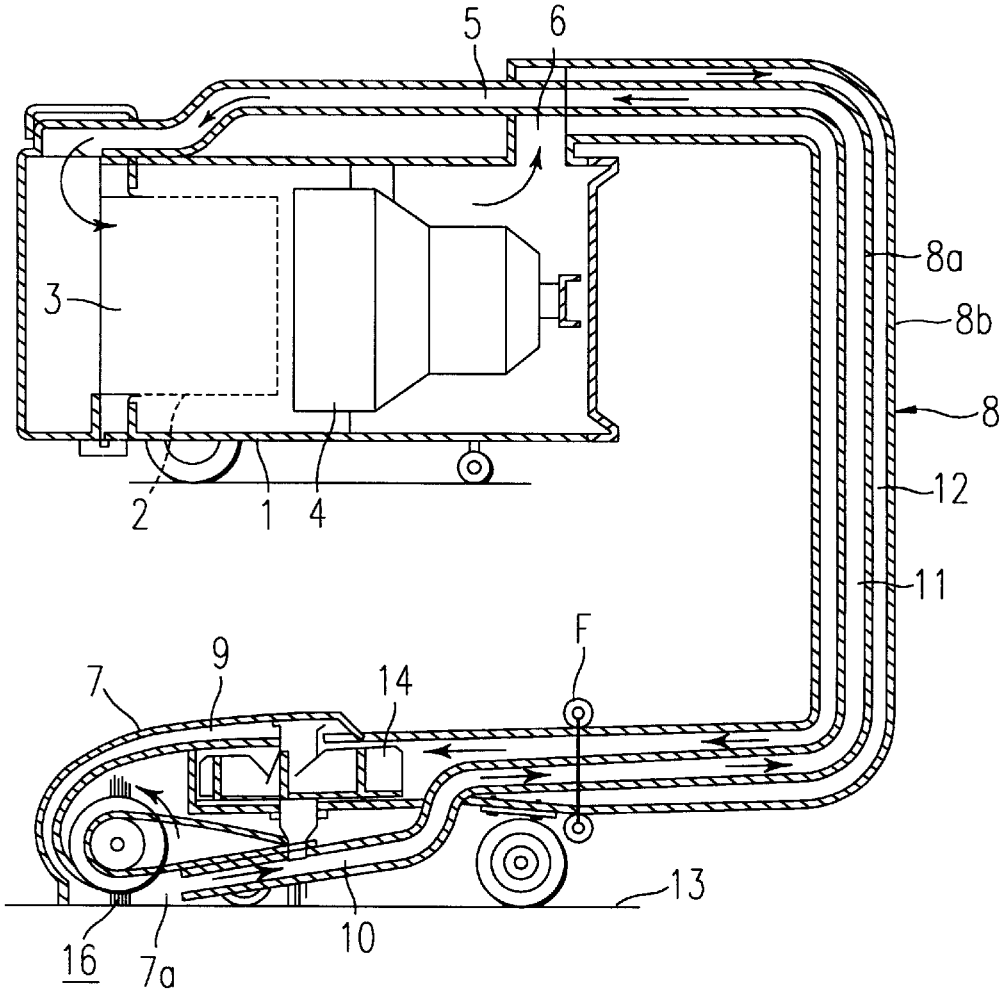
FIG. 18 PRIOR ART
FIG. 18 is a view illustrating one example of a prior art vacuum cleaner.
Figure 19:
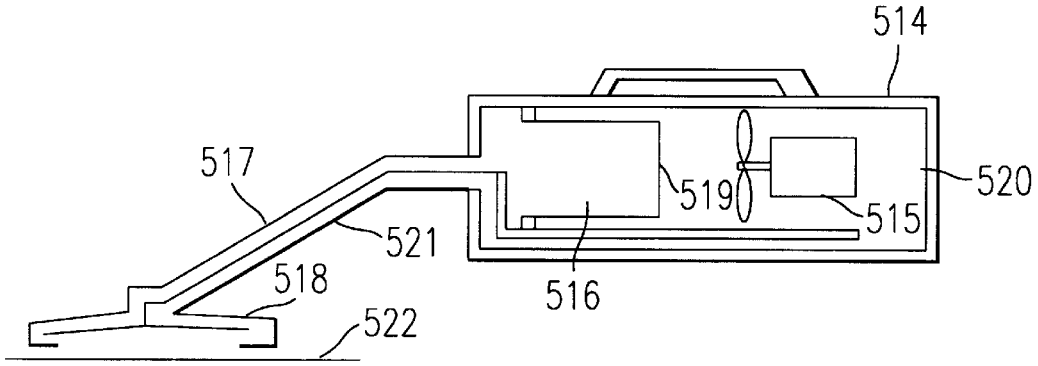
FIG. 19 PRIOR ART
FIG. 19 is a view illustrating another example of a prior art vacuum cleaner.
Figure 20:
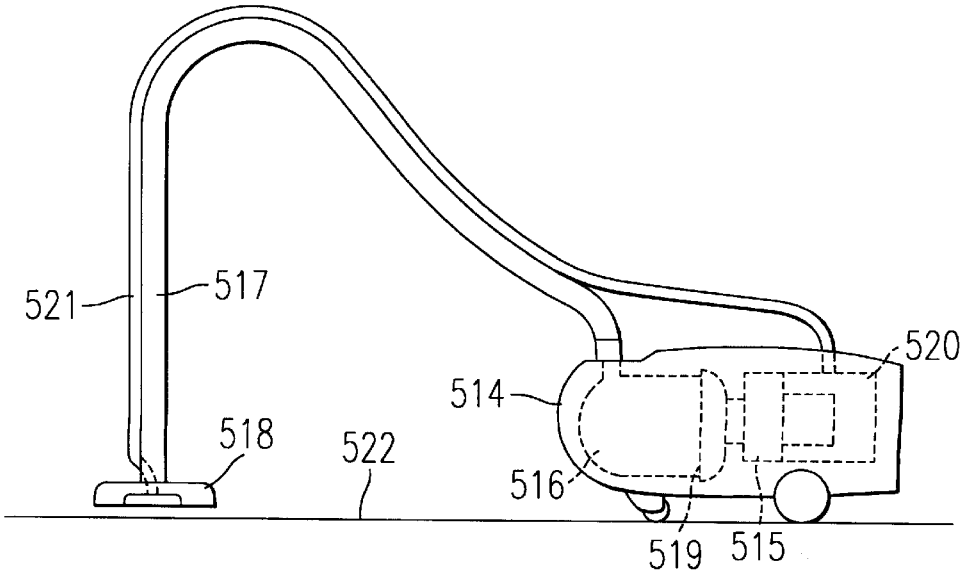
FIG. 20 PRIOR ART
FIG. 20 is a view illustrating a further example of a prior art vacuum cleaner.

A hose 230 shown in FIGS. 15 to 17 has a dual structure in which a suction hose 234 is mounted in an exhaust hose 233. When the hose 230 in FIG. 17 is connected to a connecting port 225 of the cleaner main body 20, the suction hose 234 in FIG. 15 is communicated to the dust collecting chamber 25 in FIG. 16 and the exhaust hose 233 is communicated to the exhaust chamber 26*b*.

A space between the exhaust hose 233 and the suction hose 234 is taken in FIG. 15 as an exhaust air passage 233A, and the interior of the suction hose 234 is taken as a suction air passage 234A. A lead wire L extending from the cleaner main body 20 in FIG. 16 to a handling side operating pipe 222 is laid out in FIG. 15 in the exhaust air passage 233A. A conductive terminal (not shown) connected to a conductive socket (not shown) of the connecting port 225 in FIG. 17 is connected to an end portion, on the cleaner main body 20 side, of the lead wire L in FIG. 15. An end portion, on the handling side operating pipe side, of the lead wire L is connected to an operational switch panel (not shown) of the handling side operating pipe 222. The lead wire L is laid out in such a manner as to freely follow the bending of the hose 230 and to extend along the longitudinal direction of the exhaust air passage 233A. In addition, a terminal connected to a control circuit for controlling the drive of the electric fan 28 in FIG. 16 is provided on the socket of the connecting portion 225 in FIG. 17. The lead wire L in FIG. 15 laid out in the exhaust air passage 233A is exposed to the exhaust air from the electric fan 28 in FIG. 16; however, since dust contained in the exhaust air is significantly filtered through the dust collecting filter 27 and a filter (not shown) provided between the dust collecting filter 27 and the electric fan 28, it is possible to prevent occurrence of an inconvenience that the exhaust air is clogged and/or the lead wire L of FIG. 15 is disconnected due to entanglement of dust around the lead wire L.

A handling side operating pipe 222 is provided at the other end of a hose 230. The extension pipe 23 in FIG. 17 is removably connected to the handling side operating pipe 222 and the exhaust pipe 35 of the suction port body 24 is removably connected to the leading end of the extension pipe 23' connected to the extension pipe 23.

The handling side operating pipe 222 includes a grip portion 235A and an operating portion 235B provided with an operating switch (not shown) for setting the turn-on/off and the output of the electric fan 28 in FIG. 16.

Like the hose 220, the handling side operating pipe 222 is configured such that a suction pipe portion 237 in FIG. 15 is disposed in an exhaust pipe portion 236. The exhaust pipe portion 236 is connected to the exhaust hose 233 and the suction pipe portion 237 is connected to the suction hose 234. The inside diameter of the exhaust pipe portion 236 is set to a value being 1.6 times the inside diameter of the suction pipe portion 237. With respect to the hose 230, the inside diameter of the exhaust hose 233 is set to a value being 1.6 times the inside diameter of the suction hose 234. Similarly, with respect to the extension pipe 23 of FIG. 17, the inside diameter of the outer pipe 63 in FIG. 16 is set to a value being 1.6 times the inside diameter of the inner pipe 62. In addition, each of the extension pipes 23 and 23' in FIG. 17 is not of the dual structure. That is to say, the outer and inner pipes of each of the extension pipes 23 and 23' may be separated from each other. With respect to the hose, as shown in FIGS. 8 and 9, the suction pipe and the exhaust pipe may be separated from each other and a lead wire may be laid out in the exhaust hose 131.

In the third embodiment of FIG. 16, an electrical means such as a motor, a sensor, or a light emitting element is not provided in the suction port body 24; however, if such an electrical means is provided in the suction port body 24, a lead wire may be laid out in the exhaust wire passage 38 between the outer pipe 63 and the inner pipe 62 of the connecting pipe 35 and the lead wire may be connected to the operational switch panel provided on the handling side operating pipe 222 or to the lead wire in the hose 230.

EFFECT OF THE INVENTION

As described above, according to the invention, there is provided a vacuum cleaner in which a suction side of an electric fan contained in a cleaner main body is connected to a suction port body via a suction air passage and an exhaust side of the electric fan is connected to the suction port body via an exhaust air passage, characterized in that an air passage connecting portion for removably connecting the suction port body to the cleaner main body is provided between both air passages. Accordingly, since the suction port body can be removably connected to the cleaner main body or the connecting pipe, it can be replaced by another attachment or can be, if it fails, simply exchanged for a new one.

According to the invention described, the air passage connecting portion is composed of a first connecting pipe and a second connecting pipe each of which has an inner/outer dual structure including an outer pipe and an inner pipe coaxially disposed in the outer pipe; the interior of the inner pipe is taken as either the exhaust air passage or the suction air passage and a space between the inner pipe and the outer pipe is taken as the other of the exhaust air passage and the suction air passage; and the outer pipes of the first connecting pipe and the second connecting pipe can be insertion-connected to each other, and the inner pipes of the first connecting pipe and the second connecting pipe can be insertion-connected to each other. Accordingly, since the insertion portion (connecting portion) between the outer pipes of the first and second connecting pipes and the insertion portion (connecting portion) between the inner pipes of the first and second connecting pipes are overlapped to each other, the suction port body can be simply mounted to or dismounted front the cleaner main body, the connecting pipe or the like, and also the sealing characteristic of the connecting portion between the first and second connecting pipes can be improved.

According to the invention described, at least one of the first and second connecting pipes is configured such that the leading end portion of the inner pipe projects from the leading end of the outer pipe. As a result, upon connection of the first and second connecting pipes to each other, after the inner pipes of the first and second connecting pipes are insertion-connected to each other in a visible state, the outer pipes of the first and second connecting pipes can be insertion-connected to each other in a visible state. The first and second connecting pipes can be thus easier connected to each other.

According to the invention described, an insertion-fitting portion between the outer pipes of the first and second connecting pipes and an insertion-fitting portion between the inner pipes of the first and second connecting pipes are overlapped to each other in such a manner as to be offset from each other in the axial direction. Accordingly, the edges of the connecting portions between both the inner pipes and between both the outer pipes of the first and second connecting pipes are not overlapped to each other. As a result, even if a bending stress is applied to the connecting portion between the first and second connecting pipes, at the connecting portion between the inner pipes of the first and second connecting pipes, a shear force applied from the end of one inner pipe to the other inner pipe can be reinforced by the connecting portion between the outer pipes; and at the connecting portion between the outer pipes of the first and second connecting pipes, a shear force applied from the end of one outer pipe to the other outer pipe is reinforced by the connecting portion between the inner pipes. As a result, for example, in the case where the connecting portion between the outer pipes is configured in such a manner that the small-diameter portion is provided at the end portion of one outer pipe to form the stepped portion for forming the connecting portion with no external step thereby enhancing the external appearance of the connecting portion, even if a shear stress due to bending is applied to the stepped portion, such shear stress can be reinforced by the connecting portion between the inner pipes. This arrangement makes it possible to avoid the outer pipe from being broken at the stepped portion.

According to the invention described, wherein one of the insertion-fitting portion between the outer pipes and the insertion-fitting portion between the inner pipes is a taper-fitting portion, and the other of the insertion-fitting portion between the outer pipes and the insertion-fitting portion between the inner pipes is a loosely fitting portion; and a seal member is interposed in the loosely fitting portion. Accordingly, even if there are slight dimensional variations in outside and inside diameters of the pipes, it is possible to easily connect the inner pipes to each other and also connect the outer pipes to each other while ensuring the sufficient airtightness upon connection, and hence to facilitate the manufacture of the connecting pipes.

According to the invention described, the interior of the inner pipe is taken as the suction air passage and the space between the inner pipe and the outer pipe is taken as the exhaust air passage; and the insertion-fitting portion between the inner pipes is the taper-fitting portion. Accordingly, a suction negative pressure is applied in the insertion-fitting portion in the direction where the insertion-connection between the inner pipes becomes deeper. As a result, it is possible to sufficiently ensure the airtightness of the insertion-fitting portion without provision of only seal member.

According to the invention described, there is provided a vacuum cleaner in which a suction side of an electric fan contained in a cleaner main body is connected to a suction port body via a suction air passage and an exhaust side of the electric fan is connected to the suction port body via an exhaust air passage, characterized in that at least part of the suction air passage and at least part of the exhaust air passage are respectively formed by a flexible suction hose anti a flexible exhaust hose which are connected to the cleaner main body; and the two hoses are separably juxtaposed and held. Accordingly, the flexible exhaust hose separated from the suction hose can be used for blowing dust.

According to the invention described, the two hoses are spirally twisted. Accordingly, even when the suction hose and exhaust hose are juxtaposed, they can be freely bent in an arbitrary direction.

According to the invention described, leading end portions of the two hoses are removably connected to each other by a connecting member. Accordingly, the suction hose and the exhaust hose can be firmly juxtaposed and held by holding only one position of the leading portions of both the hoses by the connecting member. This structure makes it possible to reduce the number of members for holding both the hoses. Further, the flexible exhaust hose can be simply separated from the suction hose by removing the leading ends of both the hoses from the connecting member, and the separated exhaust hose can be used for blowing dust.

According to the invention described, at least part of the suction air passage and at least part of the exhaust air passage are respectively formed by a flexible suction hose and a flexible exhaust hose which are connected to the cleaner main body; and the two hoses are separably juxtaposed and held together. Accordingly, the flexible hose separated from the suction hose can be used for blowing dust.

According to the invention described, at least part of the suction air passage and at least part of the exhaust air passage are respectively formed by a flexible suction hose and a flexible exhaust hose which are connected to the cleaner main body; and the two hoses are separably juxtaposed and held together. Accordingly, the flexible hose separated from the suction hose can be used for blowing dust.

According to the invention described, there is provided a vacuum cleaner characterized in that a pipe body for connecting a cleaner main body including an electric fan to a suction port body has a suction air passage for supplying suction air from the suction port body into the cleaner main body, and an exhaust air passage for circulating exhaust air from the electric fan into the suction port body; and a portion of the exhaust air passage extending from the cleaner main body to a handling side operating portion of the pipe body for controlling the electric fan is provided with a lead wire for controlling the electric fan by operation of the handling side operating portion. Accordingly, since the exhaust air from which dust has been already collected flows in the portion of the exhaust air passage extending from the cleaner main body to the handling side operating portion, it is possible to eliminate an inconvenience that the dust is caught by the leading wire and thereby the exhaust air passage is clogged with the entangled dust or the leading end is disconnected. Further, by extending the lead wire provided in the exhaust air passage nearly in line along the longitudinal direction of the exhaust air passage, it is possible to shorten the length of the lead wire and reduce the weight of the lead wire, and also facilitate the layout of the lead wire and simplify the configuration of the pipe body and hence to reduce the number of the manufacturing steps and the manufacturing cost.

According to the invention described, there is provided a vacuum cleaner characterized in that a pipe body for connecting a cleaner main body including an electric fan to a suction port body has a suction air passage for sucking air into the cleaner main body, and an exhaust air passage for circulating again exhaust air from the electric fan into the suction port body; and the exhaust air passage extending from the cleaner main body to the suction port body is provided with a lead wire extending to the suction port body. Accordingly, since the exhaust air from which dust has been already collected flows in the portion of the exhaust air passage extending from the cleaner main body to the handling side operating portion, it is possible to eliminate an inconvenience that the dust is caught by the leading wire and thereby the exhaust air passage is clogged with the entangled dust or the leading end is disconnected. Further, by extending the lead wire provided in the exhaust air passage nearly in line along the longitudinal direction of the exhaust air passage, it is possible to shorten the length of the lead wire and reduce the weight of the lead wire, and also facilitate the layout of the lead wire and simplify the configuration of the pipe body and hence to reduce the number of the manufacturing steps and the manufacturing cost.

According to the invention described, the lead wire is laid out in a freely bendable state. As a result, by extending the lead wire nearly in line along the longitudinal direction of the exhaust air passage, it is possible to facilitate the layout of the lead wire and reduce the weight of the lead wire, and hence to reduce the number of the manufacturing steps and the manufacturing cost.

According to the invention described, the pipe body extending from the suction port body to the cleaner main body or at least a portion of the pipe body extending from the handling side operating portion to the cleaner main body has a dual structure including the suction air passage and the exhaust air passage. As a result, by laying out the lead wire in such a manner as not to wind it spirally but to extend it nearly in line along the longitudinal direction of the exhaust air passage, it is possible to shorten the length of the lead wire and reduce the weight of the lead wire, and also facilitate the layout of the lead wire and simplify the configuration of the pipe body and hence to reduce the number of the manufacturing steps and the manufacturing cost.

According to the invention described, a lead wire is laid out in the exhaust air passage. Accordingly, since the exhaust air from which dust has been already collected flows in the exhaust air passage, it is possible to eliminate an inconvenience that the dust is caught by the leading wire and thereby the exhaust air passage is clogged with the entangled dust or the leading end is disconnected. Further, by extending the lead wire provided in the exhaust air passage nearly in line along the longitudinal direction of the exhaust air passage, it is possible to shorten the length of the lead wire and reduce the weight of the lead wire, and also facilitate the layout of the lead wire and simplify the configuration of the pipe body and hence to reduce the number of the manufacturing steps and the manufacturing cost.

What is claimed is:

1. A vacuum cleaner in which a suction side of an electric fan contained in a cleaner main body is connected to a suction port body via a suction air passage and an exhaust side of said electric fan is connected to said suction port body via an exhaust air passage, comprising:

an air passage connecting portion configured to removably connect said suction port body to said cleaner main body provided halfway between said both air passages;

wherein said air passage connecting portion is composed of a first connecting pipe and a second connecting pipe, each of which has an inner/outer dual structure including an outer pipe and an inner pipe coaxially disposed in said outer pipe;

wherein the interior of said inner pipe is taken as either said exhaust air passage or said suction air passage and a space between said inner pipe and said outer pipe is taken as the other of said exhaust air passage and said suction air passage;

wherein said outer pipes of said first connecting pipe and said second connecting pipe can be insertion-connected to each other, and said inner pipes of said first connecting pipe and said second connecting pipe can be insertion-connected to each other; and wherein at least one of said first and second connecting pipes is configured such that the leading end portion of said inner pipe projects from the leading end of said outer pipe.

2. A vacuum cleaner according to claim 1, wherein an insertion-fitting portion between said outer pipes of said first and second connecting pipes and an insertion-fitting portion between said inner pipes of said first and second connecting pipes are positioned in a partly overlapping relationship so as to be offset from each other in the axial direction.

3. A vacuum cleaner according to claim 1 or 2, wherein:

at least part of said suction air passage and at least part of said exhaust air passage are respectively formed by a flexible suction hose and a flexible exhaust hose which are connected to said cleaner main body;

said two hoses are separably juxtaposed and held together; and leading end portions of said two hoses are removable from said suction air passage and said exhaust air passage.

4. A vacuum cleaner according to claim 3, wherein a lead wire is laid out in said exhaust air passage.

5. A vacuum cleaner according to claim 2, wherein one of said insertion-fitting portion between said outer pipes and said insertion-fitting portion between said inner pipes is a taper-fitting portion, and the other of said insertion-fitting portion between said outer pipes and said insertion-fitting portion between said inner pipes is a loosely fitting portion; and a seal member is interposed in said loosely fitting portion.

6. A vacuum cleaner according to claim 5, wherein the interior of said inner pipe is taken as said suction air passage and the space between said inner pipe and said outer pipe is taken as said exhaust air passage; and said insertion-fitting portion between said inner pipes is the taper-fitting portion.

7. A vacuum cleaner according to claim 6, wherein a lead wire is laid out in said exhaust air passage.

8. A vacuum cleaner according to claim 5, wherein:

at least part of said suction air passage and at least part of said exhaust air passage are respectively formed by a flexible suction hose and a flexible exhaust hose which are connected to said cleaner main body;

said two hoses are separably juxtaposed and held together; and leading end portions of said two hoses are removable from said suction air passage and said exhaust air passage.

9. A vacuum cleaner according to claim 8, wherein a lead wire is laid out in said exhaust air passage.

10. A vacuum cleaner according to claim 1, wherein a lead wire is laid out in sald exhaust air passage.

* * * * *